US007545351B2

(12) United States Patent
Shin

(10) Patent No.: US 7,545,351 B2
(45) Date of Patent: Jun. 9, 2009

(54) DISPLAY DEVICE AND DISPLAY PANEL AND DRIVING METHOD THEREOF

(75) Inventor: Dong-Yong Shin, Suwon-si (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 651 days.

(21) Appl. No.: 11/107,450

(22) Filed: Apr. 15, 2005

(65) Prior Publication Data

US 2005/0264493 A1 Dec. 1, 2005

(30) Foreign Application Priority Data

May 31, 2004 (KR) ..... 10-2004-0038950

(51) Int. Cl.
*G09G 3/32* (2006.01)

(52) U.S. Cl. ..... 345/82; 345/76

(58) Field of Classification Search ..... 345/76–83
See application file for complete search history.

(56) References Cited

U.S. PATENT DOCUMENTS

| | | | | |
|---|---|---|---|---|
| 6,046,890 | A | 4/2000 | Yamada et al. | |
| 6,229,506 | B1 * | 5/2001 | Dawson et al. | 345/82 |
| 6,847,172 | B2 | 1/2005 | Suzuki | |
| 6,864,637 | B2 | 3/2005 | Park et al. | |
| 6,885,029 | B2 | 4/2005 | Miyazawa | |
| 7,414,599 | B2 | 8/2008 | Chung et al. | |
| 2002/0196389 | A1 | 12/2002 | Koyama | |
| 2003/0043132 | A1 | 3/2003 | Nakamura | |
| 2003/0227262 | A1 | 12/2003 | Kwon | |
| 2004/0080474 | A1 * | 4/2004 | Kimura | 345/82 |
| 2004/0090400 | A1 * | 5/2004 | Yoo | 345/76 |
| 2004/0104870 | A1 | 6/2004 | Mametsuka | |

(Continued)

FOREIGN PATENT DOCUMENTS

CN 1312535 A 9/2001

(Continued)

OTHER PUBLICATIONS

Patent Abstracts of Japan, Publication No. 10-254412, dated Sep. 25, 1998, in the name of Mitsuharu Nakazawa et al.

(Continued)

*Primary Examiner*—Bipin Shalwala
*Assistant Examiner*—Kenneth B Lee, Jr.
(74) *Attorney, Agent, or Firm*—Christie, Parker & Hale, LLP

(57) ABSTRACT

A display device includes a plurality of pixel circuits formed in a matrix; a plurality of first scan lines for transmitting selection signals to select one or more of the pixel circuits; a plurality of second scan lines for transmitting emission control signals to control the duration of one or more emissions of the selected one or more pixel circuits; and a scan driver for sequentially delaying a primary signal. The primary has a pulse at a first level at about a first period for generating a plurality of secondary signals. The plurality of secondary signals are inverted for outputting the emission control signals, and a signal is generated having a pulse at a second level when at least one of the secondary signals and at least one of the emission control signals are at the first level.

35 Claims, 11 Drawing Sheets

U.S. PATENT DOCUMENTS

| | | | |
|---|---|---|---|
| 2004/0145547 | A1 | 7/2004 | Oh |
| 2004/0239599 | A1 | 12/2004 | Koyama |
| 2005/0068271 | A1 | 3/2005 | Lo |
| 2005/0093464 | A1 | 5/2005 | Shin et al. |
| 2005/0156829 | A1 | 7/2005 | Choi et al. |

FOREIGN PATENT DOCUMENTS

| | | | |
|---|---|---|---|
| CN | 1490779 | A | 4/2004 |
| CN | 1577453 | A | 2/2005 |
| EP | 1 496 495 | A2 | 1/2005 |
| JP | 10-254412 | | 9/1998 |
| JP | 2001-147659 | | 5/2001 |
| JP | 2002-328643 | | 11/2002 |
| JP | 2003-140612 | | 5/2003 |
| JP | 2004-029791 | | 1/2004 |
| JP | 2005-134874 | | 5/2005 |
| KR | 2003-0095215 | | 12/2003 |
| KR | 10-2005-004108 | | 5/2005 |

OTHER PUBLICATIONS

Patent Abstracts of Japan, Publication No. 2001-147659, dated May 29, 2001, in the name of Machio Yamagishi et al.

Patent Abstracts of Japan, Publication No. 2002-328643, dated Nov. 15, 2002, in the name of Munehiro Asami et al.

Korean Patent Abstracts, Publication No. 1020060095215 A, dated Dec. 18, 2003, in the name of O Gyeong Kwon.

European Search Report dated Feb. 28, 2007, for EP 06120752.8, in the name of Samsung SDI Co., Ltd.

Korean Patent Abstracts, Publication No. 1020050041088A, dated May 4, 2005, in the name of Keum Nam Kim.

Patent Abstracts of Japan, Publication No. 2003-140612, dated May 16, 2003, in the name of Hitoshi Tsuge.

Patent Abstracts of Japan, Publication No. 2004-029791, dated Jan. 29, 2004, in the name of Oh-Kyong Kwon.

Patent Abstracts of Japan, Publication No. 2005-134874, dated May 26, 2005, in the name of Dong-Yong Shin.

SIPO Office action dated Aug. 8, 2008, for China application 200610127463X, with English translation indicating relevance of listed reference in this IDS.

U.S. Office action dated Dec. 22, 2005, for related U.S. Appl. No. 10/969,438 (U.S. Patent 7,129,643) to indicate relevance of references in Mar. 1, 2006 IDS.

* cited by examiner

DISPLAY DEVICE AND DISPLAY PANEL AND DRIVING METHOD THEREOF

CROSS REFERENCE TO RELATED APPLICATION

This application claims priority to and the benefit of Korean Patent Application No. 10-2004-0038950 filed on May 31, 2004 in the Korean Intellectual Property Office, the entire content of which is incorporated herein by reference.

BACKGROUND OF THE INVENTION

1. Field of the Invention

The present invention relates to a display device and a driving method thereof, and more particularly, it relates to an organic light emitting diode (also referred to as "OLED," hereinafter) display device, a display panel, and a driving method thereof.

2. Description of the Related Art

In general, an EL display device is a display device that electrically excites phosphorus organic components, and represents an image by voltage-programming or current-programming m×n numbers of organic light emitting pixels. As shown in FIG. 1, each of these organic light emitting pixels includes anode (indium tin oxide: ITO), organic thin film, and cathode (metal) layers. The organic thin film layer has a multi-layered structure including an emission layer (EML), an electron transport layer (ETL), and a hole transport layer (HTL) so as to balance electrons and holes and thereby enhance efficiency of light emission. Further, the organic thin film includes an electron injection layer (EIL) and a hole injection layer (HIL).

Methods of driving the organic light emitting pixels can include a passive matrix method and an active matrix method. The active matrix method employs a thin film transistor (TFT). In the passive matrix method, an anode and a cathode are formed crossing each other, and a line is selected to drive the organic light emitting pixels. On the other hand, in the active matrix method, each indium tin oxide (ITO) pixel electrode (or anode) is coupled to the TFT and the light emitting pixel is driven in accordance with a voltage maintained by the capacitance of a capacitor coupled to a gate of the TFT. The active matrix method can also be classified into a voltage programming method and a current programming method depending on a type of signals transmitted to the capacitor so as to distinctively control the voltage applied to the capacitor.

FIG. 2 is an equivalent circuit diagram of a pixel circuit according to a conventional voltage-programming method.

Referring now to FIG. 2, a conventional organic EL display device employing the voltage-programming method supplies currents to an organic light emitting pixel or OLED through a transistor M coupled thereto for light emission, and the amount of current supplied to the OLED is adjusted by a data voltage applied through a switching transistor M2. Herein, a capacitor C1 is coupled between a source and a gate of the transistor M1 to maintain the amount of the data voltage applied during a predetermined time period.

When the transistor M2 is turned on, the data voltage is applied to the gate of the transistor M1, and a voltage of $V_{GS}$ between the gate and the source is charged to the capacitor C1. A current $I_{OLED}$ flows corresponding to the voltage of $V_{GS}$, and the OLED emits light corresponding to the current $I_{OLED}$.

Herein, the current flowing to the OLED is given as Equation 1.

$$I_{OLED} = \frac{\beta}{2}(V_{GS} - |V_{TH}|)^2 = \frac{\beta}{2}(V_{DD} - V_{DATA} - |V_{TH}|)^2 \quad \text{[Equation 1]}$$

where $I_{OLED}$ represents a current flowing to the OLED, $V_{GS}$ represents a voltage between the gate and the source of the transistor M1, $V_{TH}$ represents a threshold voltage of the transistor M1, $V_{DATA}$ represents a data voltage, and β represents a constant number.

As shown in Equation 1, the current corresponding to the data voltage is supplied to the OLED, and the OLED emits light corresponding to the current supplied thereto. Herein, the data voltage has multi-level values within a predetermined range to express gray scales.

However, a pixel circuit according to a conventional voltage-programming method has a problem in expressing high-level gray scales due to a deviation of a threshold voltage $V_{TH}$ at a driving transistor or a TFT and a mobility of a carrier. The deviation can result from a non-uniform manufacturing process of the TFT. For example, when a pixel circuit drives a TFT in a pixel by applying 3V thereto to express 8-bit gray scales (256 gray scales), a voltage should be applied to a gate of the TFT at an interval of less than 12 mV (=3V/256). However, it is difficult to express such a high gray scale in the case that the deviation of the threshold voltage $V_{TH}$ is 100 mV due to the non-uniform manufacturing process. Moreover, the deviation of the mobility of the carrier causes the value of β to be changed in Equation 1, and thus expressing the high level gray scale becomes even more difficult.

By contrast, although the amount of current and voltage supplied from a driving transistor to each of the pixels may not be uniform, the circuit of the pixels employing a current-programming method can still have a uniform panel as long as the currents supplied from a current source to the pixel circuit are uniform.

FIG. 3 shows an equivalent circuit diagram of a pixel circuit according to a conventional current-programming method.

As shown in FIG. 3, a transistor M1 is coupled to an OLED to supply a current for light emission, and the amount of the current is adjusted by a data current applied through a transistor M2.

Accordingly, when transistors M2 and M3 are turned on, a voltage corresponding to the data current $I_{DATA}$ is stored in a capacitor C1, and then the amount of current corresponding to the voltage stored in the capacitor C1 flows to the OLED so that the OLED can emit light. Herein, the current flowing to the OLED is given as Equation 2.

$$I_{OLED} = \frac{\beta}{2}(V_{GS} - |V_{TH}|)^2 = I_{DATA} \quad \text{[Equation 2]}$$

where $V_{GS}$ represents a voltage between a gate and a source of a transistor M1, $V_{TH}$ represents a threshold voltage of the transistor M1, and β represents a constant number.

As shown in Equation 2, the current flowing throughout a panel can be uniform since the amount of the current $I_{OLED}$ flowing to the OLED and the amount of the data current $I_{DATA}$ are the same according to the conventional current-programming method. However, if a weak current ($I_{DATA}$) flows to the OLED, it takes too much time to charge data lines. For instance, assume that the load of capacity in the data line is set to be 30 pF. In this case, it takes several milliseconds to charge the load of the capacity with data currents of several tens of nA to several hundreds of nA. However, line time is inefficient for fully charging the data line since it is limited to several μs.

On the other hand, if the amount of the current $I_{OLED}$ flowing to the OLED is increased to reduce time for charging the data line, brightness of all the pixels may be increased, thereby resulting in a decrease of image quality.

SUMMARY OF THE INVENTION

It is an aspect of the present invention to provide a light emission device capable of compensating a threshold voltage or shifting of a transistor and fully charging data lines.

In one exemplary embodiment of the present invention, a display device includes a plurality of data lines, a plurality of first scan lines, and a plurality of pixel circuits. The plurality of data lines transmits data signals. The plurality of first scan lines transmits selection signals. The plurality of pixel circuits are respectively coupled to the data lines and the first scan lines. At least one of the pixel circuits includes an emission device for displaying an image, a first switch, a transistor, a first storage device, a second storage device, and a second switch. The emission device displays the image corresponding to data currents supplied thereto. The first switch transmits at least one of the data signals transmitted through the data lines in response to at least one of the selection signals of at least one of the first scan lines. The transistor is diode-connected while the at least one data signal is transmitted from the first switch. The first storage device is coupled between a first transistor electrode and a control electrode of the transistor, and stores a first voltage corresponding to the at least one data signal from the first switch. The second storage device is coupled to the control electrode of the transistor and a second scan electrode for transmitting a first control signal, and switches the first voltage of the first storage device into a second voltage by coupling with the first storage device when the first control signal is changed into a second level from a first level. The second switch transmits a current outputted from the transistor to the emission device in response to a second control signal. The first control signal is set to be maintained at the first level during a horizontal period.

In one exemplary embodiment of the present invention, a display device includes a display panel, a data driver, a first scan driver, and a second scan driver. The display panel includes a plurality of data lines, a plurality of first scan lines, a plurality of second scan lines, and a plurality of pixel circuits. The plurality of data lines transmits data signals. The plurality of first scan lines transmits selection signals. The plurality of second scan lines transmits emission control signals. The plurality of pixel circuits respectively couple to the data lines, the first scan lines, and the second scan lines. The data driver applies the data signals to the data lines. The first scan driver applies the selection signals to the first scan lines. The second scan driver applies the emission control signals to the second scan lines. The first scan driver and the second scan driver include a shift register for sequentially delaying a first signal having a pulse at a first level by a first period to generate a plurality of second signals. The first scan driver includes a first logical operator and a second logical operator. The first logical operator receives two adjacent second signals outputted from the shift register, and outputs a third signal having a pulse at a fourth level when the two second signals are both at a third level. The second logical operator receives the third signal outputted from the first logical operator and a fourth signal having a pulse at the third-level for a part of a horizontal period, and outputs a signal having a pulse at the third-level as at least one of the selection signals when the third signal and the fourth signal both are at the fourth level. The second scan driver receives the two adjacent second signals outputted from the shift register, and outputs a signal having a pulse at the fourth-level as at least one of the emission control signals when one of the two adjacent second signals is at the third level.

In one exemplary embodiment of the present invention, a display panel has a plurality of data lines for transmitting data signals, a plurality of scan lines for transmitting selection signals, and a plurality of pixel circuits formed on a plurality of pixels respectively defined by the data lines and the scan lines. At least one of the pixel circuits includes an emission device, a first switch, a transistor, a first storage device, a second storage device, and a second switch. The emission device displays an image corresponding to data currents supplied thereto. The first switch transmits at least one of the data signals transmitted through at least one of the data lines in response to at least one of the selection signals of at least one of the scan lines. The transistor supplies a driving current to drive the emission device, and is diode-connected while the data signal is transmitted from the first switch. The first storage device is coupled between a first transistor electrode and a control electrode of the transistor. The second storage device is coupled between the control electrode of the transistor and a signal line for supplying a first control signal. The second switch couples a second transistor electrode of the transistor and the emission device in response to a second control signal. When the at least one selection signal is in an enable period, the enable period is set to be included in a horizontal period, and the second control signal includes a disable period that is set to be an integer-numbered times of the horizontal period.

In one exemplary embodiment of the present invention, a method for driving a display device is provided. The display device includes a plurality of data lines, a plurality of first scan lines, a plurality of second scan lines, and a plurality of pixel circuits. The plurality of data lines transmits data signals. The plurality of first scan lines transmit selection signals. The plurality of second scan lines transmit first control signals. The plurality of pixel circuits are respectively coupled to the data lines and the first scan lines, and at least one of the pixel circuits includes a first switch, a transistor, a first storage device, a second storage device, and an emission device. The first switch transmits a data current from at least one of the data lines in response to a pulse at a first level pulse of at least one of the selection signals. The transistor has a first transistor electrode and a control electrode. The first storage device is formed between the first transistor electrode and the control electrode. The second storage device is formed between the control electrode and at least one of the second scan lines. The emission device displays an image corresponding to a current from the transistor. In the method, at least one of the first control signals is changed to a fourth level from a third level and is maintained in the fourth level during a horizontal period. The at least one selection signal is changed from a second level to the first level and a voltage corresponding to the data current is charged to the first storage device during a first period. The at least one first control signal is changed from the fourth level to the third level to change the voltage in the first storage device.

BRIEF DESCRIPTION OF THE DRAWINGS

The accompanying drawings, together with the specification, illustrate exemplary embodiments of the present invention, and, together with the description, serve to explain the principles of the present invention, wherein.

DETAILED DESCRIPTION

Figure 1:
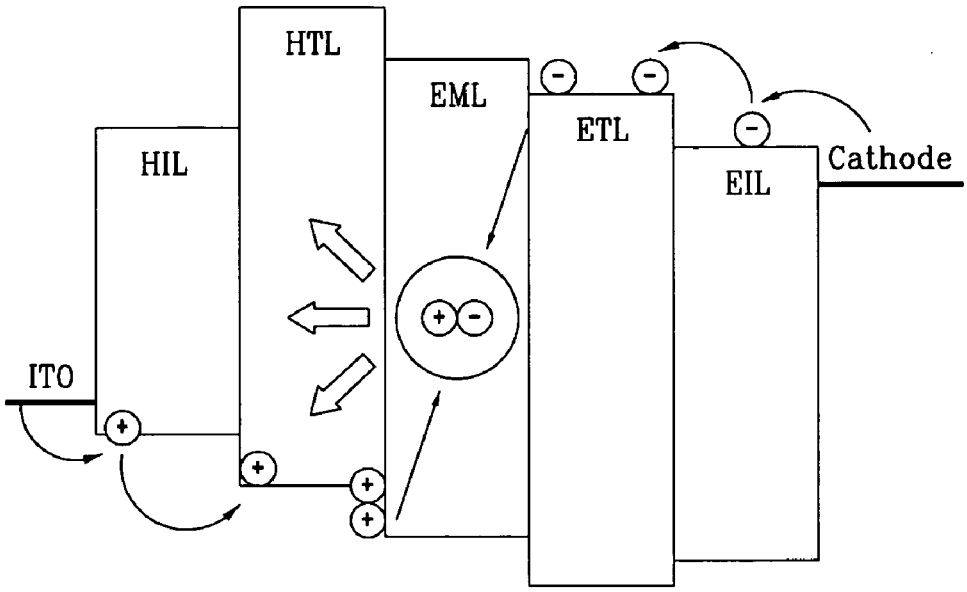
FIG. 1 illustrates a conceptual organic light emitting pixel or an OLED.
Figure 2:
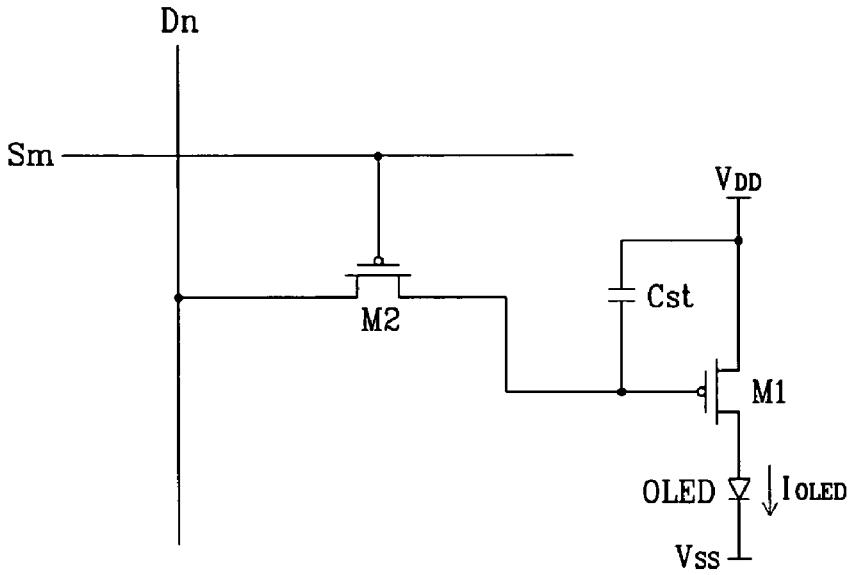
FIG.2 (Prior Art)
FIG. 2 shows an equivalent circuit diagram of a pixel according to a conventional voltage-programming method.
Figure 3:
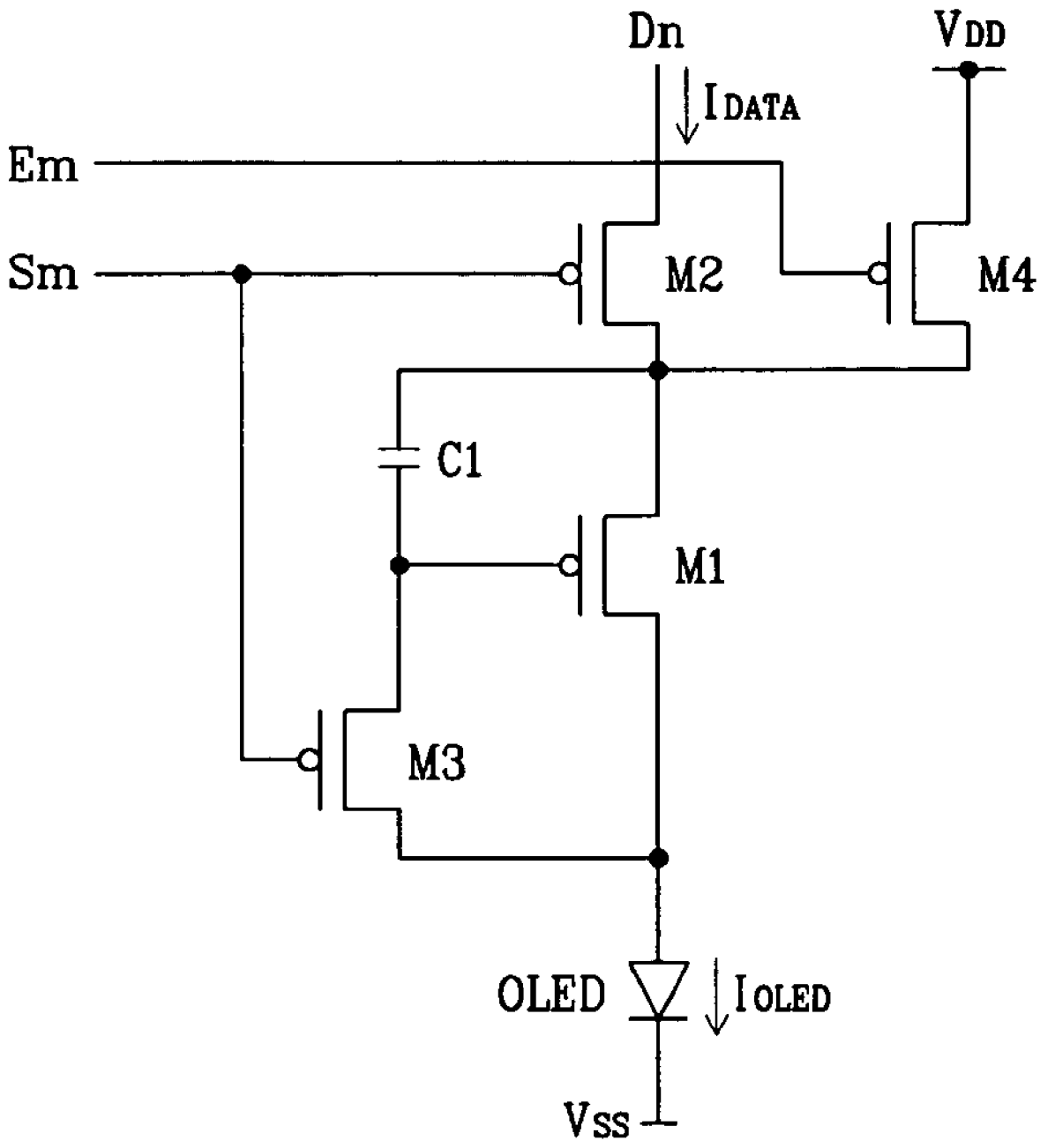
FIG.3 (Prior Art)
FIG. 3 shows an equivalent circuit diagram of a pixel according to a conventional current-programming method.

In the following detailed description, only certain exemplary embodiments of the present invention are shown and described, simply by way of illustration. As those skilled in the art would realize, the described embodiments may be modified in various different ways, all without departing from the spirit or scope of the present invention. Accordingly, the drawings and description are to be regarded as illustrative in nature, and not restrictive. There may be parts shown in the drawings or parts not shown in the drawings that are not discussed in the specification as they are not essential for a complete understanding of the invention. Like reference numerals designate like elements. Phrases such as "one thing coupled to another" can refer to either "directly coupling a first one to a second one" or "coupling the first one to the second one with a third one provided therebetween."

Figure 4:
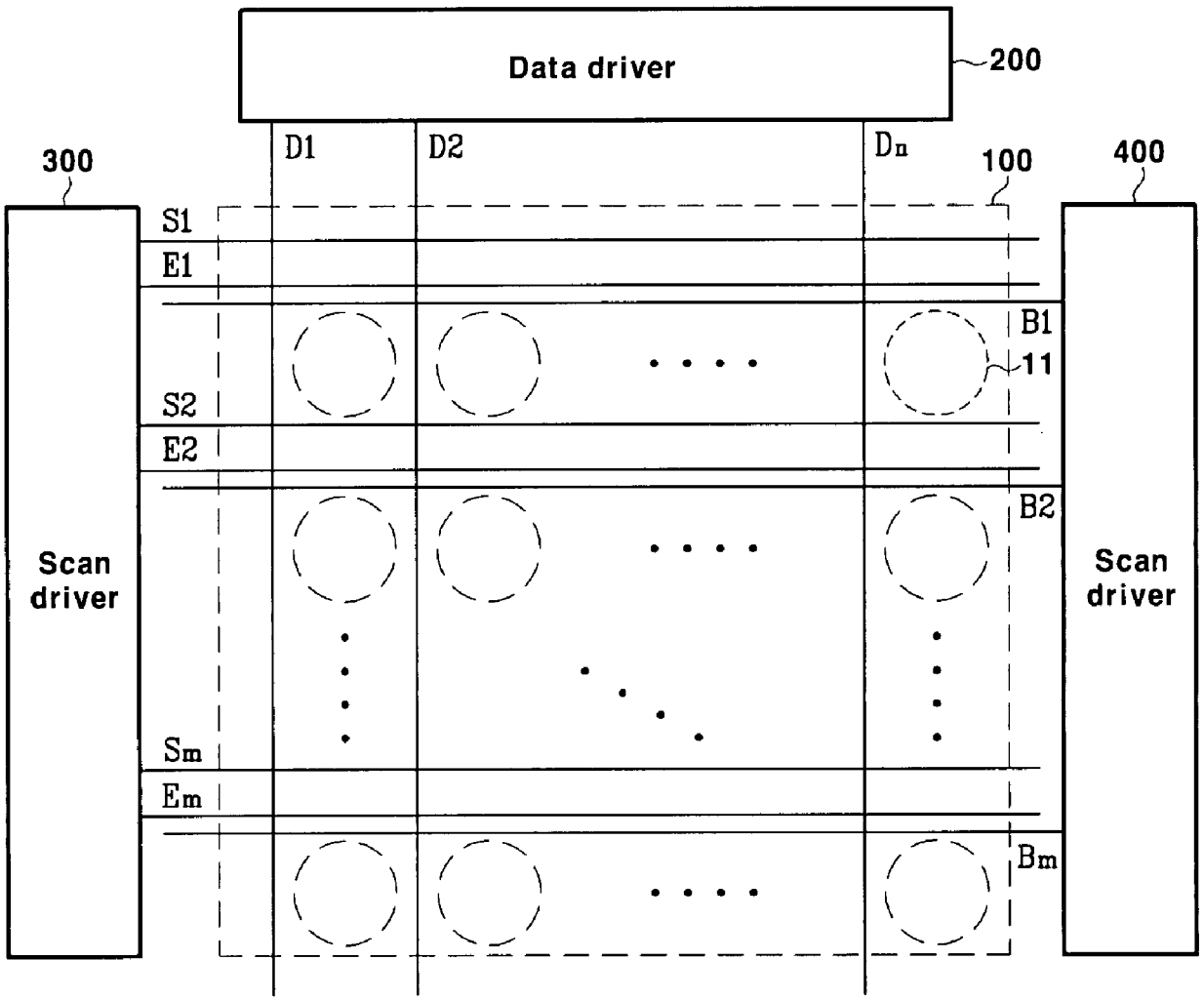
FIG. 4 is a schematic plan view of an OLED according to an embodiment of the present invention.

FIG. 4 is a plan view schematically illustrating a light emission device according to an embodiment of the present invention.

As shown in FIG. 4, the light emission device according to the embodiment of the present invention includes an organic EL display panel (hereinafter also referred to as "display panel") 100, a data driver 200, and scan drivers 300 and 400.

The display panel 100 includes data lines $D_1$ to $D_n$ arranged in columns, a plurality of scan lines $S_1$ to $S_m$, $E_1$ to $E_m$, and $B_1$ to $B_m$ arranged in rows, and a plurality of pixel circuits 11. The data lines $D_1$ to $D_n$ transmit data currents as image signals to the pixel circuits 11. The selection scan lines $S_1$ to $S_m$ transmit a selection signal to the pixel circuits 11, and emission scan lines $E_1$ to $E_m$ transmit an emission control signal to the pixel circuits 11. Further, the boost scan lines $B_1$ to $B_m$ transmit a boost signal to the pixel circuits 11. The pixel circuits 11 are formed in areas respectively defined by adjacent data lines and selection signals.

In operation, the data driver 200 applies the data currents to the data lines $D_1$ to $D_n$, and the scan driver 300 sequentially applies the selection signals to the selection scan lines $S_1$ to $S_m$ and the emission scan lines $E_1$ to $E_m$. Further, the scan driver 400 applies the boost signals to the boost scan lines $B_1$ to $B_m$.

Figure 5:
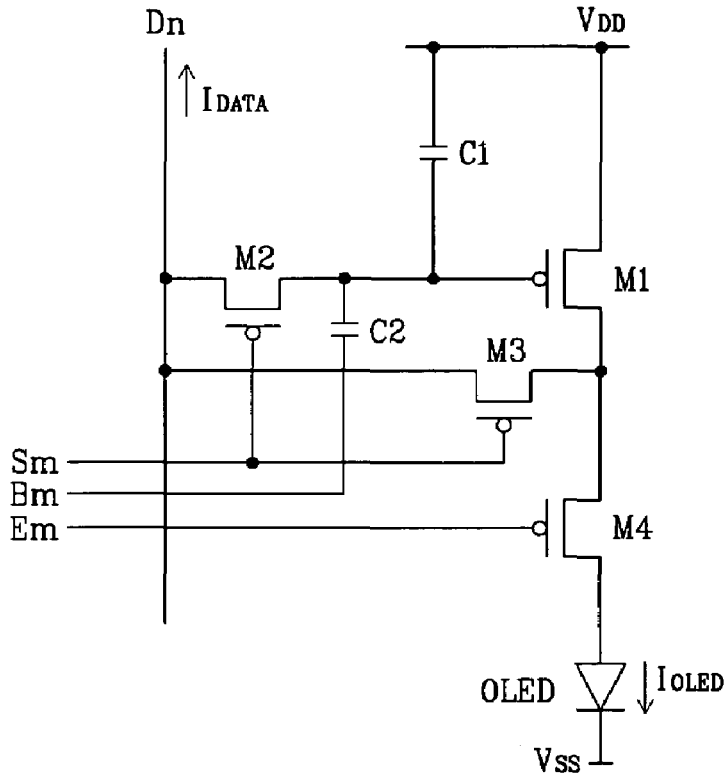
FIG. 5 is a pixel circuit diagram according to an embodiment of the present invention.

Referring to FIG. 5, a pixel circuit 11 of FIG. 4 according to an exemplary embodiment of the present invention will be described hereinafter. As shown, FIG. 5 illustrates the pixel circuit 11 coupled to the nth data line $D_n$ and the mth scan lines $S_m$, $E_m$, and $B_m$, for exemplary purposes and the invention is not thereby limited.

The pixel circuit 11 according to the embodiment of the present invention includes an OLED, a driving transistor M1, switching transistors M2 to M4, and capacitors C1 and C2.

The switching transistor M2 is coupled between the data line Dn and a gate of the driving transistor M1. When the switching transistor M2 is turned on, in response to a selection signal transmitted from the selection scan line $S_m$, a data current $I_{DATA}$ flows from the driving transistor M1 to the data line $D_n$. The switching transistor M3 is coupled between a drain and the gate of the driving transistor M1, and diode-connects the driving transistor M1 in response to the selection signal from the selection scan line $S_m$.

A source of the driving transistor M1 is coupled to a power voltage VDD and the drain of the driving transistor M1 is coupled to the switching transistor M4. The gate-source voltage of the driving transistor M1 is determined corresponding to the data current $I_{DATA}$, and the capacitor C1 is coupled between the gate and the source of the driving transistor M1 so as to maintain the gate-source voltage of the driving transistor M1 during a predetermined time period. The capacitor C2 is coupled between the boost scan line $B_m$ and the gate of the driving transistor M1 so as to adjust a voltage at the gate of the driving transistor M1.

The switching transistor M4 supplies a current flowing to the driving transistor M1 to the OLED in response to the emission control signal from the emission scan line $E_m$. The OLED is coupled between the switching transistor M4 and a power voltage VSS and emits light corresponding to the amount of the current flowing from the driving transistor M1.

In FIG. 5, each of the switching transistors M2 to M4 is shown as a P-channel transistor, but each or at least one of these switching transistors can be provided as an N-channel transistor in other embodiments of the present invention. Also, these transistors M2 to M4 can be replaced with other devices capable of switching both ends thereof in response to application of a control signal. Further, the driving transistor M1 can be replaced with an N-channel transistor. The detail for modifying a circuit structure when using the one or more N-channel transistors is known to those skilled in the art and is therefore not provided in more detail. In addition, the transistors M1 to M4 can be thin-film transistors respectively having a gate electrode, a drain electrode, and a source electrode that respectively function as a control electrode and two main electrodes.

FIGS. 6 to 9 illustrate a driving method of a pixel circuit according to first, second, third, and fourth embodiments of the present invention.

Figure 6:
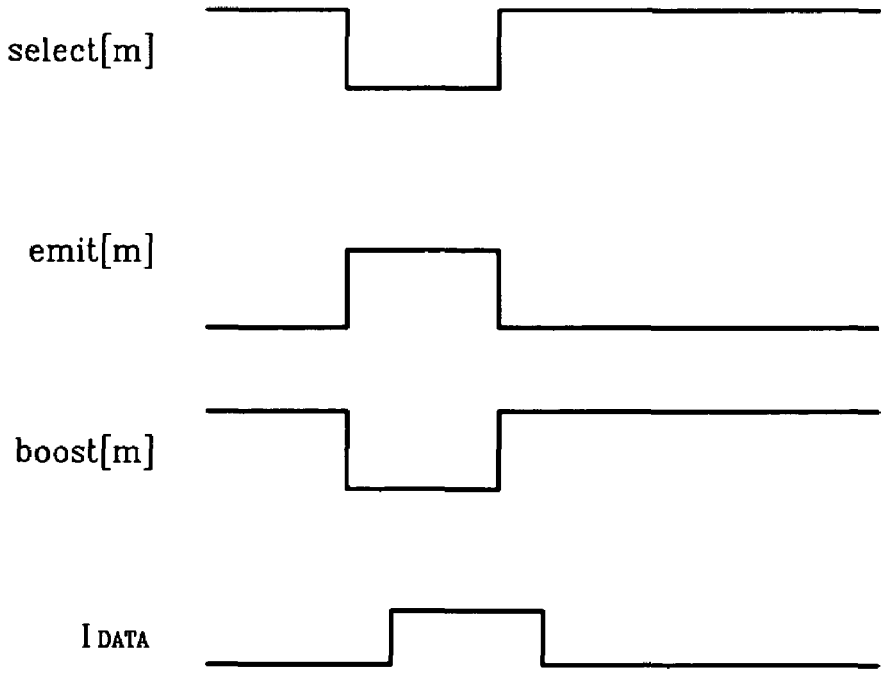
FIG. 6 is a driving waveform to drive the pixel circuit of FIG. 5 according to a first embodiment of the present invention.

FIG. 6 shows the driving waveform to drive the pixel circuit in FIG. 5 according to the first embodiment of the present invention.

In FIG. 6, a selection signal select[m] applied to the selection scan line Sm becomes a low-level signal, the transistors M2 and M3 are turned on and the driving transistor M1 is diode-connected while allowing the data current $I_{DATA}$ to flow to the driving transistor M1 from the data line Dn.

In addition, when the boost signal boost[m] applied to the boost scan line Bm becomes low, a low-level voltage is applied to the boost scan line Bm of the capacitor C2.

The emission control signal emit[m] applied to the emission scan line Em is maintained at a high level (disable level), and thus the transistor M4 is turned off and the driving transistor M1 and the OLED are electrically decoupled.

As such, a relationship between an absolute voltage value (hereinafter, also referred to as "gate-source voltage") $V_{GS}$ between the gate and the source of the driving transistor M1 and the current data $I_{DATA}$ flowing to the driving transistor M1 can be given as Equation 3, and the gate-source voltage $V_{GS}$ of the driving transistor M1 can be given as Equation 4.

$$I_{DATA} = \frac{\beta}{2}(V_{GS} - |V_{TH}|)^2 \quad \text{[Equation 3]}$$

where β represents a constant value and $V_{TH}$ represents an absolute value of a threshold voltage of the driving transistor M1.

$$V_{GS} = V_{DD} - V_G = \sqrt{\frac{2I_{DATA}}{\beta}} + |V_{TH}| \quad \text{[Equation 4]}$$

where $V_G$ represents a gate voltage of the driving transistor M1, and $V_{DD}$ represents a voltage supplied to the driving transistor M1 by the power voltage $V_{DD}$.

Next, the transistors M2 and M3 are turned off and the transistor M4 is turned on when the selection signal select[m] becomes a high-level (disable-level) signal and the emission control signal emit[m] becomes a low-level (enable-level) signal.

Further, when the boost signal boost[m] is changed from the low-level signal into the high level, a voltage at a point where the capacitor C2 and the boost scan line Bm meet each other can be increased to as much as the amount $\Delta V_B$ of the boost signal is increased. Accordingly, the gate voltage $V_G$ of the driving transistor M1 can be increased by $\Delta V_B$ by the coupling of the capacitor C2 with the boost scan line Bm as given in Equation 5.

$$\Delta V_G = \frac{\Delta V_B C_2}{C_1 + C_2} \quad \text{[Equation 5]}$$

where C1 and C2 respectively represent capacitance of the capacitors C1 and C2.

Since the gate voltage $V_G$ of the driving transistor M1 is increased by $\Delta V_G$, the current $I_{OLED}$ flowing to the driving transistor M1 is given as Equation 6. In other words, the drain current $I_{OLED}$ of the driving transistor M1 can be set to be lower than the data current $I_{DATA}$ because the gate-source voltage $V_{GS}$ of the driving transistor M1 is decreased in proportion to the increase of the gate voltage $V_G$ of the driving transistor M1. Accordingly, charging time for the data lines can be sufficiently prepared (or reduced) while still controlling (or allowing) weak currents to flow to the OLED.

Further, the transistor M4 is turned on by the emission control signal of the emission scan line Em, and therefore the current $I_{OLED}$ of the driving transistor M1 is supplied to the OLED which thereby emits light.

$$I_{OLED} = \frac{\beta}{2}(V_{GS} - \Delta V_G - |V_{TH}|)^2 = \frac{\beta}{2}\left(\sqrt{\frac{2I_{DATA}}{\beta}} - \Delta V_G\right)^2 \quad \text{[Equation 6]}$$

Further, the data current $I_{DATA}$ can be given as Equation 7 that is derived from Equation 6.

$$I_{DATA} = I_{OLED} + \Delta V_G\sqrt{2\beta I_{OLED}} - \frac{\beta}{2}(\Delta V_G)^2 \quad \text{[Equation 7]}$$

In FIG. 6, timing of each of the selection signal select[m], the emission control signal emit[m], and the boost signal boost[m] is described to be the same, but it is not restricted thereto.

Figure 7:
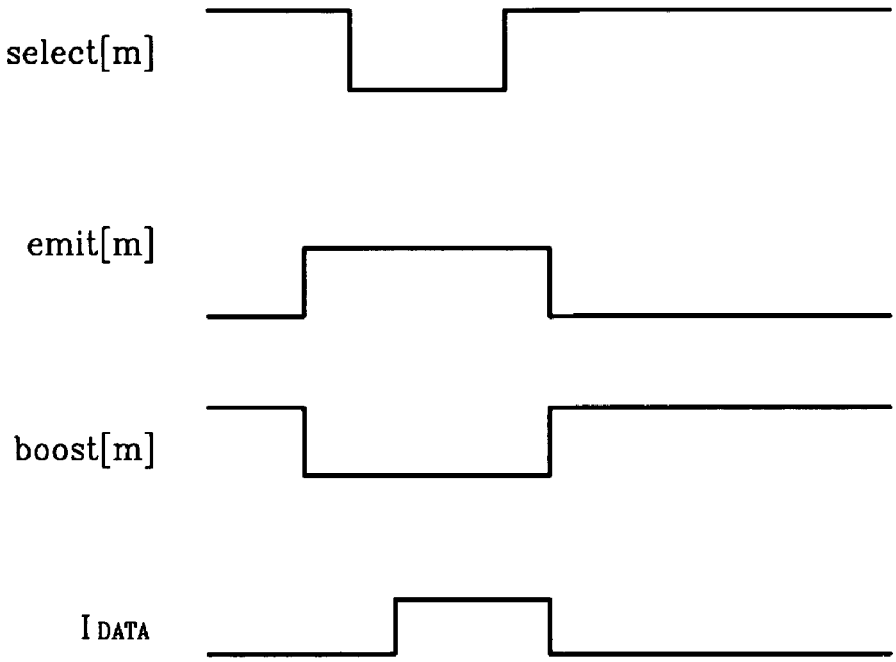
FIG. 7 is a driving waveform to drive the pixel circuit of FIG. 5 according to a second embodiment of the present invention.

FIG. 7 describes the driving waveform according to the second embodiment of the present invention.

In FIG. 7, the transistor M4 should be turned off while the transistors M2 and M3 are turned on by the selection signal select[m] applied to the selection scan line Sm so as to allow the data current $I_{DATA}$ to flow to the driving transistor M1. However, when the transistor M4 is turned on to allow the data current $I_{DATA}$ to flow to the OLED while the data current $I_{DATA}$ flows to the driving transistor M1, the data current $I_{DATA}$ and the current $I_{OLED}$ flowing to the OLED are added together and flow to the drain of the driving transistor M1, and a voltage corresponding to this current is programmed to the capacitor C1. Meanwhile, delay and rising timing of the selection signal select[m] can differ from delay and falling timing of the emission control signal emit[m] due to a load difference between the selection scan line Sm and the emission scan line Em, or characteristics of the transistor(s) in the circuit (or butter). As such, the transistor M4 can be properly turned off while the transistor M2 is turned on by adjusting the off-level pulse of the emission control signal emit[m] to be ended in a period after the on-level pulse of the selection signal select[m]ends, as shown in FIG. 7.

The end of the low pulse of the boost signal boost[m] from the boost scan line Bm should not be prior to the end of the on-level pulse of the selection signal select[m], otherwise the data current $I_{DATA}$ is programmed after the node voltage of the capacitor C2 is increased, thereby resulting in the purpose of increasing the node voltage of the capacitor C2 to become useless. Therefore, the on-level pulse of the selection signal select[m] transmitted to the selection scan line Sm should be adjusted to end in a period prior to the end of the low pulse of the boost signal boost[m] in order to prevent the node voltage of the capacitor C2 from being increased prior to the completion of the data current $I_{DATA}$ programming, as shown in FIG. 7.

Further, the voltage at the capacitor C1 can be changed due to falling of the node voltage of the capacitor C2 while the voltage is programmed to the capacitor C1 in the case that the start of the low pulse of the boost signal boost[m] starts before the start of the on-level pulse of the selection signal select[m] starts. Once the voltage at the capacitor C1 is changed, the voltage programming process should be started over again thereby resulting in a lack of time for programming the voltage to the capacitor C1. Therefore, the start of the pulse of the selection signal select[m] should be prior to the start of the low pulse of the boost signal boost[m] so as to program the data current $I_{DATA}$ after the node voltage of the capacitor C2 falls, as shown in FIG. 7.

Figure 8:
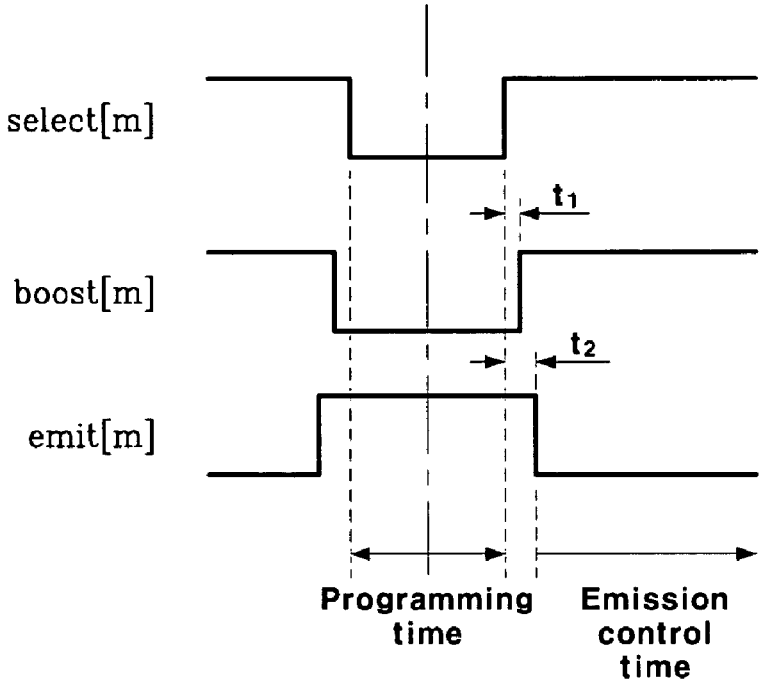
FIG. 8 is a driving waveform to drive the pixel circuit of FIG. 5 according to a third embodiment of the present invention.

FIG. 8 illustrates the driving waveform according to the third embodiment of the present invention.

According to the timing of pulses shown in FIG. 7, if the load difference between the boost scan line Bm and the emission scan line Em or the characteristic difference between transistors used in the circuit (or buffer) causes the ending timing between the off-level pulse of the emission control signal emit[m] and the low pulse of the boost signal boost[m] to be changed is substantially the same, the node voltage of the capacitor C2 flows to the OLED between the end of the low pulse of the boost signal boost[m] and the end of the off-level pulse of the emission control signal emit[m] when the off-level pulse of the emission control signal emit[m] is ended before the low pulse of the boost signal boost[m] ends. As a result, the OLED comes to be under much stress. Repetition of this process can cause a lifespan of the OLED to be shortened. To prevent this problem, the low pulse of the boost signal boost[m] transmitted to the boost scan line Bm should end prior to the end of the off-level pulse of the emission control signal emit[m] transmitted to the emission scan line Em so as to control the data current to flow to the OLED after the node voltage of the capacitor C2 is increased. Further, though the off-level of the emission control signal emit[m] is described in the above embodiment, on-level of the emission control signal emit[m] can also be used instead of the off-level in PMOS typed transistor.

Meanwhile, when the off-level pulse of the emission control signal emit[m] starts after the low pulse of the boost signal boost[m] starts, the node voltage of the capacitor C2 falls and the current flows to the OLED during a period between the start of the pulse of the emission control signal emit[m] and the start of the pulse of the boost signal boost[m]. As a result, the OLED comes to be under much stress, and repetition of this process can shorten a lifespan of the OLED. Therefore, the off-level pulse of the emission control signal emit[m] transmitted to the emission scan line Em should start prior to the start of the low pulse the boost signal boost[m] transmitted to the boost scan line Bm so as to control the node voltage of the capacitor C2 falls after the transistor M4 is turned off, as shown in FIG. 8.

In other words, the problems that may occur due to the load difference between the scan lines Sm, Em, and Bm, and the characteristic of the circuit (or buffer) can be solved by setting the length of the off-level pulse of the emission control signal emit[m] to be the same as one horizontal period for one scan line, and cutting both ends of the on-level pulse of the selection signal select[m] by t2 so that the length of the on-level pulse of the selection signal select[m] is shorter than the off-level pulse of the emission control signal emit[m]. Further, the length of the boost signal boost[m] is set to be longer than that of the selection signal select[m] by elongating both ends of the low pulse of the boost signal boost[m] by t1 (herein, t1<t2).

However, adjusting the length of the pulses of these signals causes data programming time to be reduced by twice t2 compared to the one horizontal period, and thus data programming to the pixel circuit may not be fully completed.

For instance, in a portrait-type of Quarter Video Graphic Array (QVGA) measuring 320 pixels wide by 240 pixels high, a horizontal period is 52 μs. Assume that t2 is set to be 4 μs. In this case, the data programming time is reduced by 15% (twice t2) so that the data may not be completely programmed and thereby degrading image quality. In this case, the higher the resolution, the more severe the problem becomes.

Figure 9:
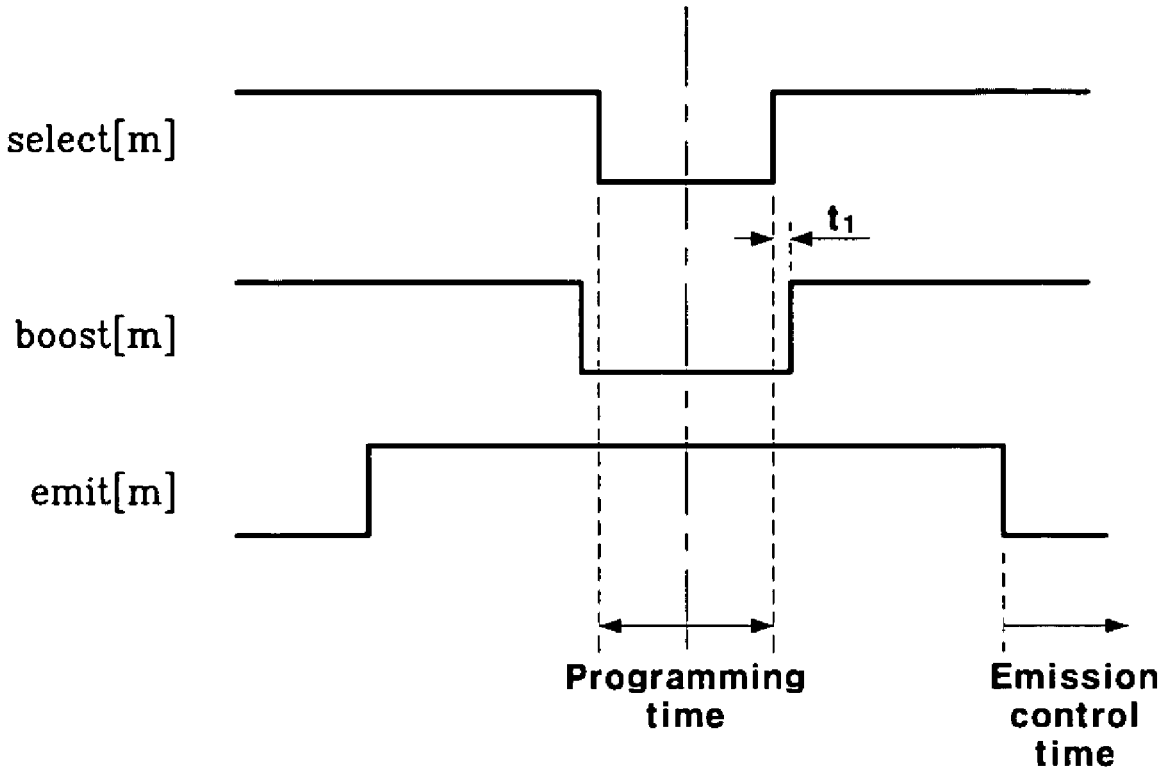
FIG. 9 is a driving waveform to drive the pixel circuit of FIG. 5 according to a fourth embodiment of the present invention.

FIG. 9 shows the driving waveform to drive the pixel circuit in FIG. 5 according to the fourth embodiment of the present invention.

In the fourth embodiment of the present invention, the low pulse width of the boost signal boost[m] is set to be the same as the horizontal period, and both ends of the on-level pulse of the selection signal select[m] are shorter than the horizontal period by t1. Sequentially, the data current $I_{DATA}$ is programmed before the node voltage of the capacitor C2 is increased and after the node voltage of the capacitor C2 is decreased.

Further, the off-level pulse width of the emission control signal emit[m] is set to be greater than n times the horizontal period (herein, n≧2, n is an integer) so as to control the current to be flowed to the OLED after the node voltage of the capacitor C2 is increased, and to control the node voltage of the capacitor C2 to be decreased after the current flowing to the OLED is cut off when the transistor M4 is turned off.

As such, the time for data programming can be extended by adjusting the margins of the switching timing in the selection scan signal select[m], the emission scan signal emit[m], and the boost scan signal boost[m].

Hereinafter, configurational and operational aspects of the scan driver 300 for generating the waveform of FIG. 9 will be described with reference to FIG. 10 and FIG. 11.

Figure 10:
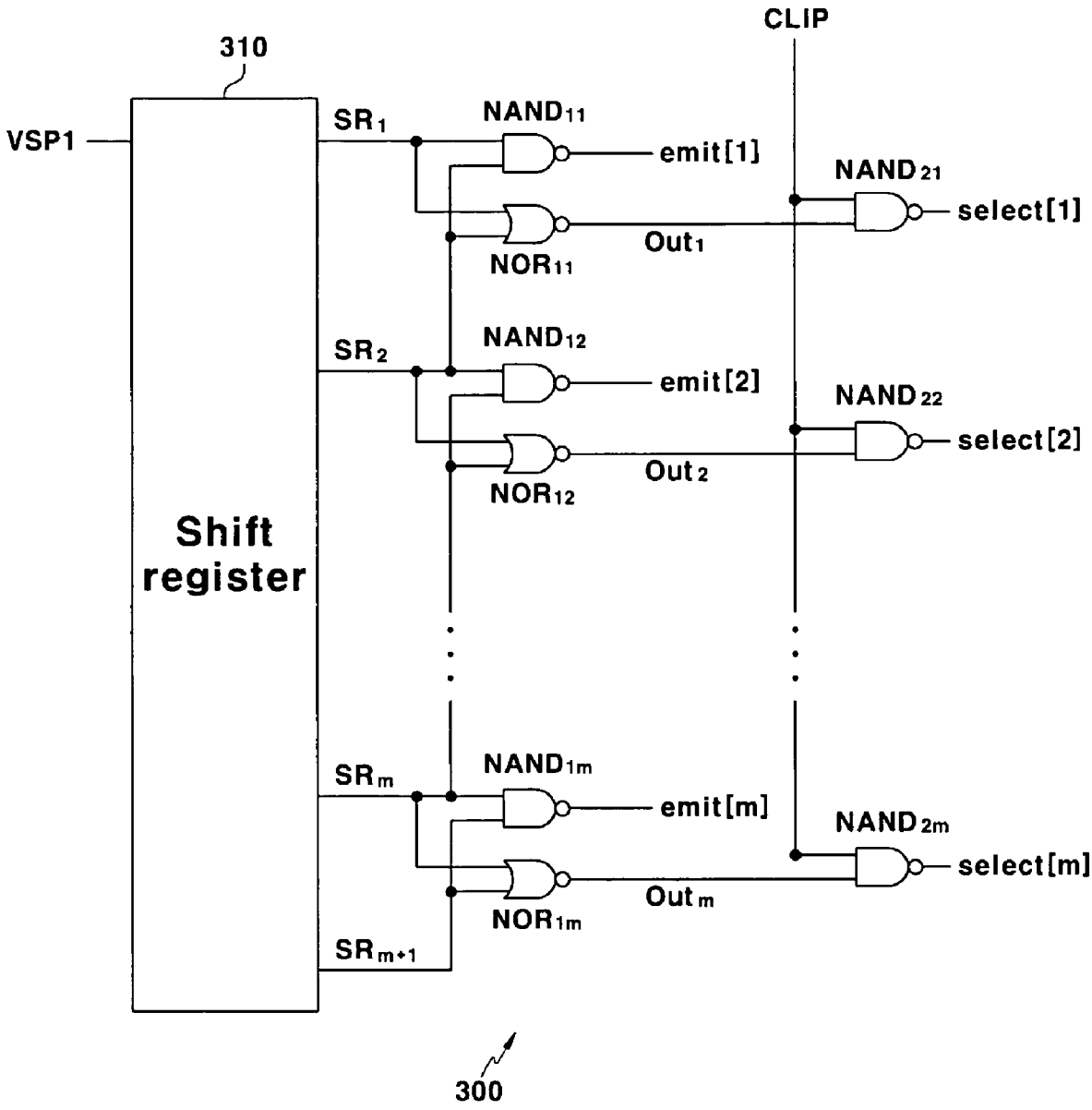
FIG. 10 illustrates a scan driver to generate a selection signal and an emission control signal of FIG. 9 according to an exemplary embodiment of the present invention.
Figure 11:
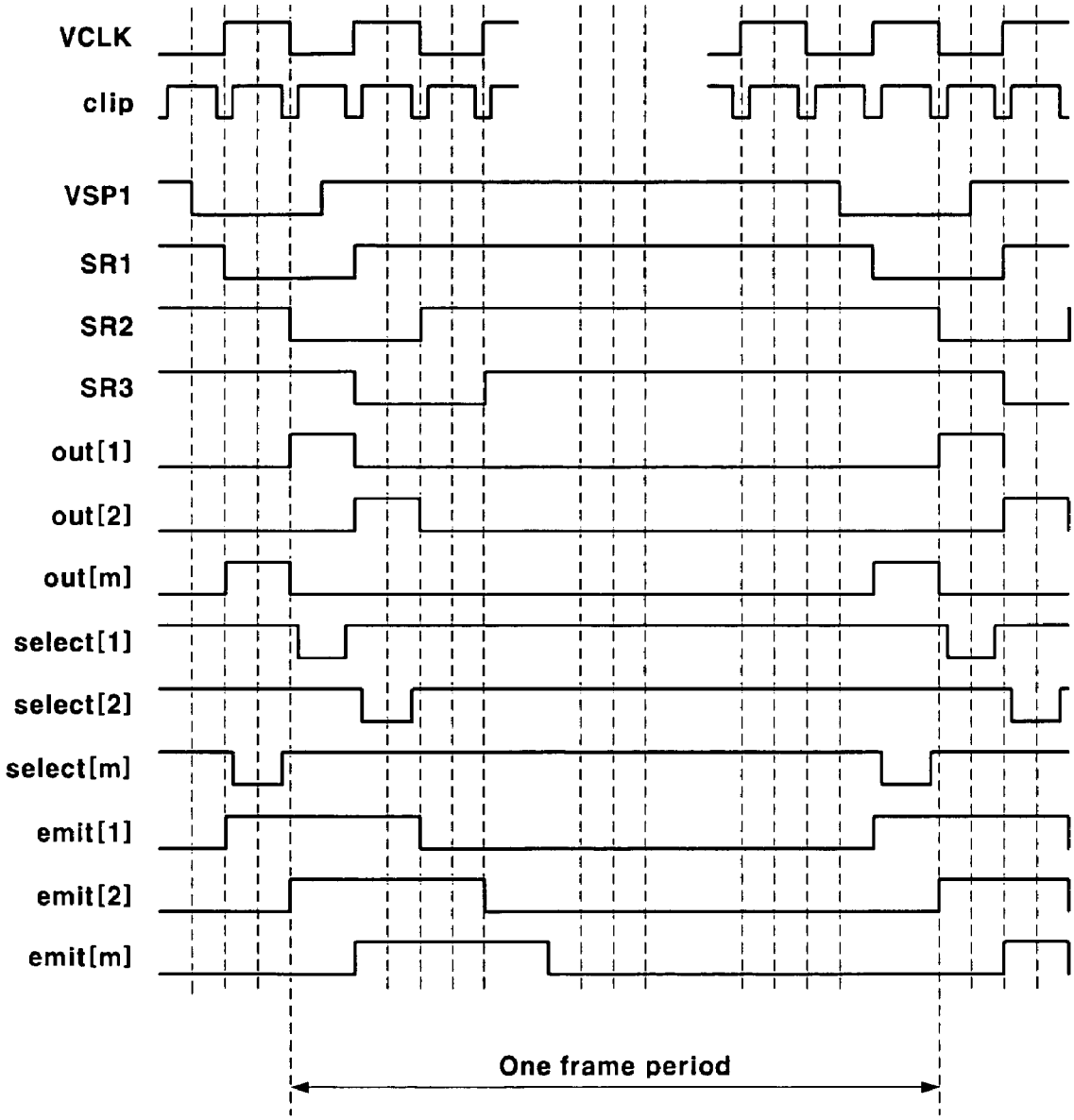
FIG. 11 shows a drive timings of the scan driver of FIG. 10.

FIG. 10 illustrates a circuit diagram of the scan driver 300 for generating the selection signal and the emission control signal of FIG. 9, according to an embodiment of the present invention, and FIG. 11 illustrates drive timings of the scan driver 300.

As shown in FIG. 10, the scan driver 300 includes a shift register 310, first NAND gates $NAND_{11}$ to $NAND_{1m}$, NOR gates $NOR_{11}$ to $NOR_{1m}$, and second NAND gates $NAND_{21}$ to $NAND_{2m}$. Assume that the number of the first and second NAND gates $NAND_{11}$ to $NAND_{1m}$ and NAND gates $NAND_{21}$ to $NAND_{2m}$, and the NOR gates $NOR_{11}$ to $NOR_{1m}$, respectively correspond to the number of select scan lines $S_1$ to $S_m$.

The shift register 310 receives a start signal VSP1 when a clock signal VCLK is high, and outputs an output signal having the same level as the start signal VSP1 and maintains the output signal SR1 at the same level until the next high-level clock signal VCLK. Then, the shift register 310 sequentially outputs a plurality of output signals $SR_2$ to $SR_{m+1}$ while shifting the output signal SR1 by a half clock signal VCLK.

According to an embodiment of the present invention, the scan driver 300 sets the horizontal period to be the same as a half period of the clock signal VCLK so as to decrease frequency of the clock signal VCLK. However, the output signals $SR_1$ to $SR_{m+1}$ correspond to an integer multiple of the clock signal VCLK, the shift register 310 of FIG. 10 is set to sequentially generate output signals while shifting the output signal $SR_1$ by a half clock signal VCLK, and then generates a series of overlapped signals from each of adjacent output signals using the NOR gates $NOR_{11}$ to $NOR_{1m}$ and sets the pulse width of the series of overlapped signals $Out_1$ to $Out_m$ to be the same as the horizontal period.

In other words, the NOR gate $NOR_{1i}$ performs the NOR operation on these two output signals $SR_i$ and $SR_{i+1}$ that are adjacent to each other among the output signals $SR_1$ to $SR_{m+1}$ of the shift register 310 so as to generate the signal $Out_i$. The NOR gate $NOR_i$ generates a high-level signal only when input signals are low, but the output signal $SR_i$ of the shift register 310 is maintained at the low level during one clock signal period. Herein, the output signal $SR_{i+1}$ is shifted by a half clock signal VCLK, and therefore the signal $Out_i$ of the NOR gate $NOR_{1i}$ is maintained at the high level during a half clock signal period.

The first NAND gate $NAND_{1i}$ performs the NAND operation on these two output signals $SR_i$ and $SR_{i+1}$ that are adjacent to each other among the output signals $SR_1$ to $SR_{m+1}$ of the shift register 310 so as to generate an emission control signal emit[i]. The output signal emit[i] of the first NAND gate is maintained at the high-level signal when one of the output signals $SR_i$ and $SR_{i+1}$ is low according to the NAND operation (herein, 1<I<m, i is an integer).

That is, the emission control signal emit[i] is maintained at the high level while the output signals $SR_i$ and $SR_{i+1}$ are outputted, and these output signals $SR_i$ and $SR_{i+1}$ are respectively maintained at the low level during one clock signal VCLK. Herein, the output signal $SR_{i+1}$ is generated by shifting the output signal $SR_i$ by a half clock signal VCLK, and therefore the output signal $SR_{i+1}$ is maintained at the high level during three times the half clock signal period. In other words, the $SR_{i+1}$ is maintained at the high level during three horizontal periods.

Further, the second NAND gate $NAND_{2i}$ performs the NAND operation on the signal $Out_i$ of the NOR gate $NOR_{1i}$ and a clip signal CLIP, and generates a selection signal select [i]. The selection signal select[i] is maintained at the high level when the clip signal CLIP is low in the inverted signals of the signals $Out_i$ to $Out_m$ generated from the NOR gate $NOR_i$.

Herein, selection signals select[1] to select[m] of which both ends are shorter than the horizontal period by t1 can be generated in the case that the clip signal CLIP is maintained at the low level during t1 at both ends of the high-level pulse of the output signals Out1 to Outm.

Hereinafter, an internal configuration and operation of the shift register according to the embodiment of FIG. 10 will be described with reference to FIG. 12 and FIG. 13.

Figure 12:
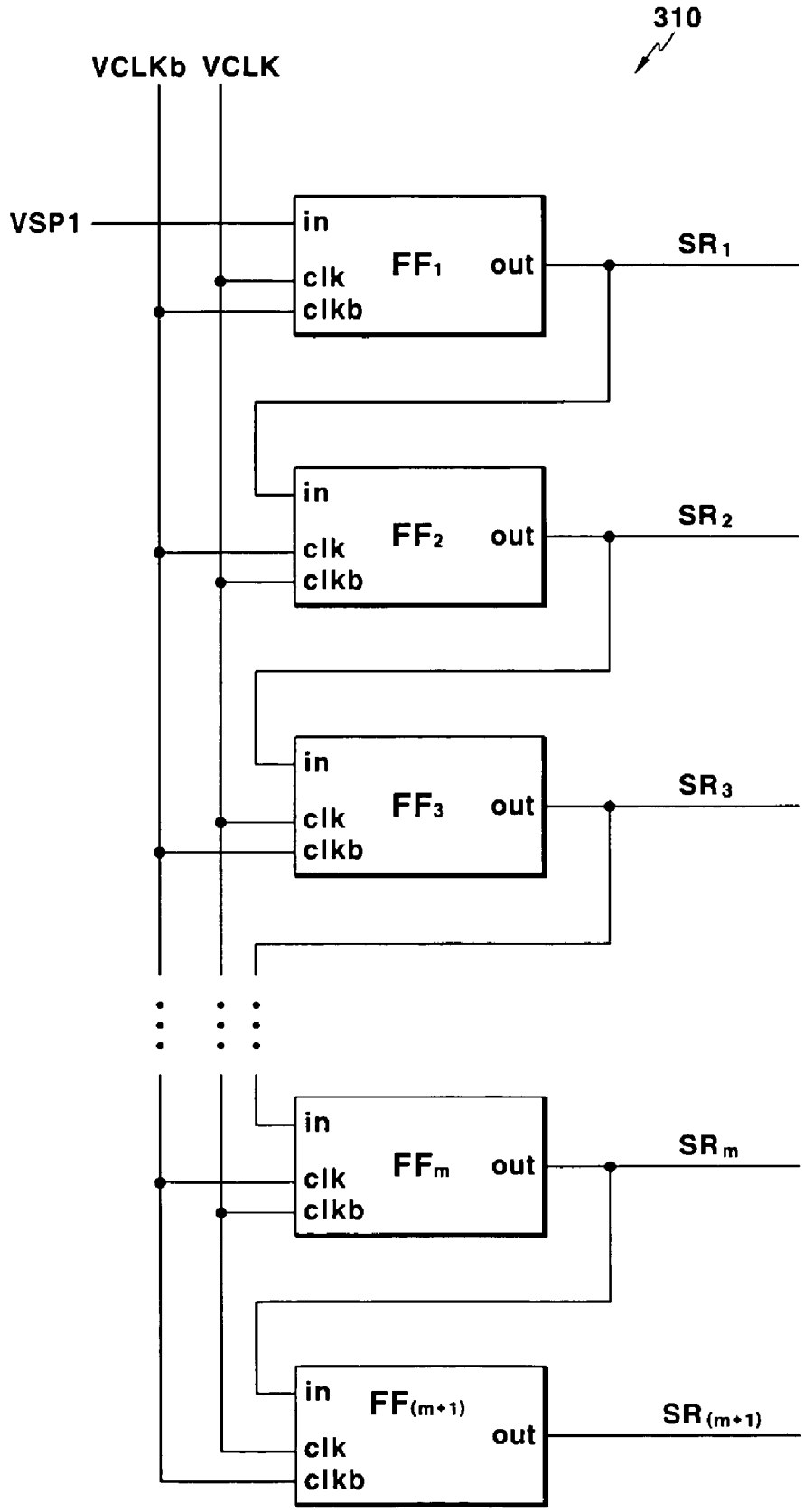
FIG. 12 is a schematic circuit diagram of a shift register of FIG. 10.
Figure 13:
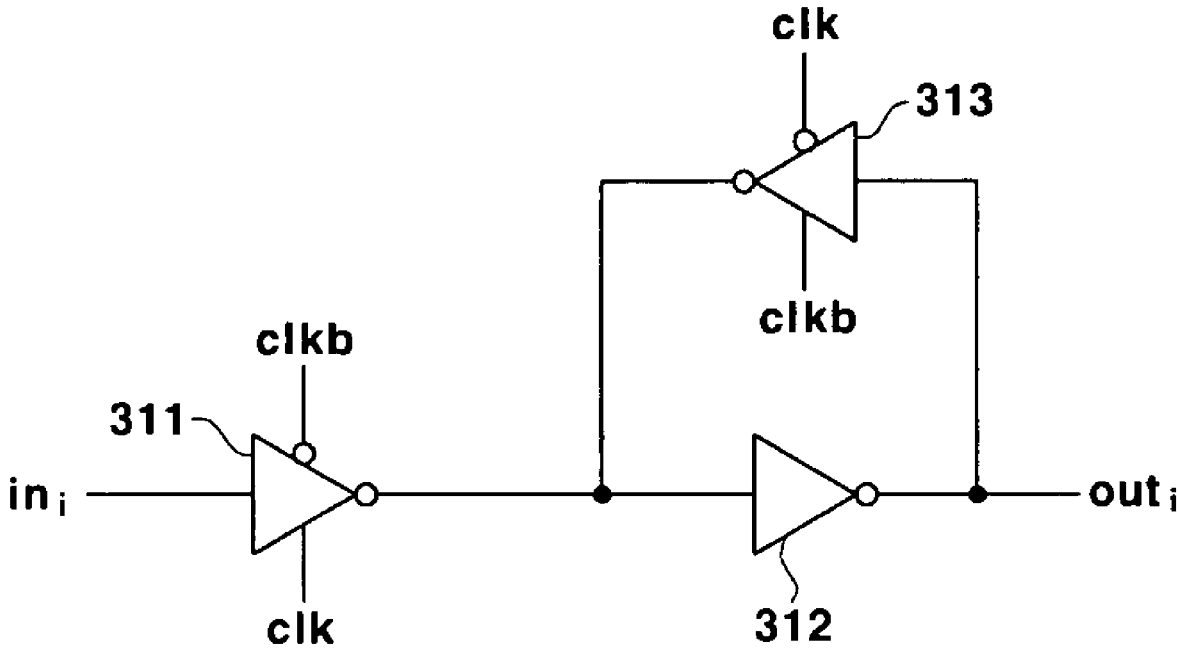
FIG. 13 illustrates a flip-flop used for the shift register of FIG. 12.

FIG. 12 schematically illustrates the shift register 310, and FIG. 13 illustrates flip-flops used for the shift register 310. A clock signal VCLKb in FIG. 12 and FIG. 13 is an inverted signal of the clock signal VCLK.

As shown in FIG. 12, the shift register 310 includes (m+1) flip-flops $FF_1$ to $FF_{m+1}$, and output signals of the respective flip-flops $FF_1$ to $FF_{m+1}$ become output signals $SR_1$ to $SR_{i+1}$ of the shift register 310. The start signal VSP1 is inputted to the first flip-flop FF1, and the ith flip-flop $FF_i$ signal becomes an input signal of the (i+1)th flip-flop $FF_{i+1}$.

As described, the output signals $SR_1$ to $SR_{m+1}$ of the shift register 310 should be shifted by a half clock signal VCLK, and thus the clock signals VCLK and VCLKb are inverted in the adjacent flip-flops $FF_i$ and $FF_{i+1}$.

In a longitudinal direction in FIG. 12, odd numbered flip-flops $FF_i$ receive the clock signals VCLK and VCLKb as internal clock signals clk and clkb, and even numbered flip-flops $FF_{i+1}$ receive the clock signals VCLKb and VCLK as the internal clock signals clk and clkb.

The flip-flop $FF_i$ outputs an input signal (in) as it is when the clock signal clk is high, but the flip-flop $FF_i$ latches the input signal (in) to output during the low-level period when the clock signal clk is low. However, the output signal $SR_{i+1}$ of the flip-flop $FF_{i+1}$ is shifted by a half clock signal VCLK with respect to the output signal $SR_i$ of the flip-flop $FF_i$ since the output signal $SR_i$ of the flip-flop $FF_i$ becomes an input signal of the flip-flop $FF_{i+1}$ and the clock signals VCLK and VCLKb are inverted and inputted to the adjacent flip-flops $FF_i$ and $FF_{i+1}$.

Hereinafter, an embodiment of the flip-flop $FF_i$ of FIG. 12 will described with reference to FIG. 13.

As shown in FIG. 13, the flip-flop $FF_i$ includes an inverter 312 forming a latch on a first three-phase inverter 311 provided in an input terminal of the flip-flop $FF_i$, and a second three-phase inverter 313. When the clock signal clk is high, the first three-phase inverter 311 inverts the input signal (in) as an output, and the inverter 312 inverts an output signal of the three-phase inverter 311 as an output. When the clock signal clk is low, the first three-phase inverter 311 is blocked and the output signal of the inverter 312 is inputted to the second three-phase inverter 313, and an output signal of the second three-phase inverter 313 is inputted to the inverter 312. Further, the output signal of the inverter 312 becomes the signal $Out_i$ of the flip-flop $FF_i$. In other words, the flip-flop $FF_i$ outputs the input signal (in) as it is when the clock signal clk is high, and latches the input signal (in) in the high level when the clock signal clk is low.

Figure 14:
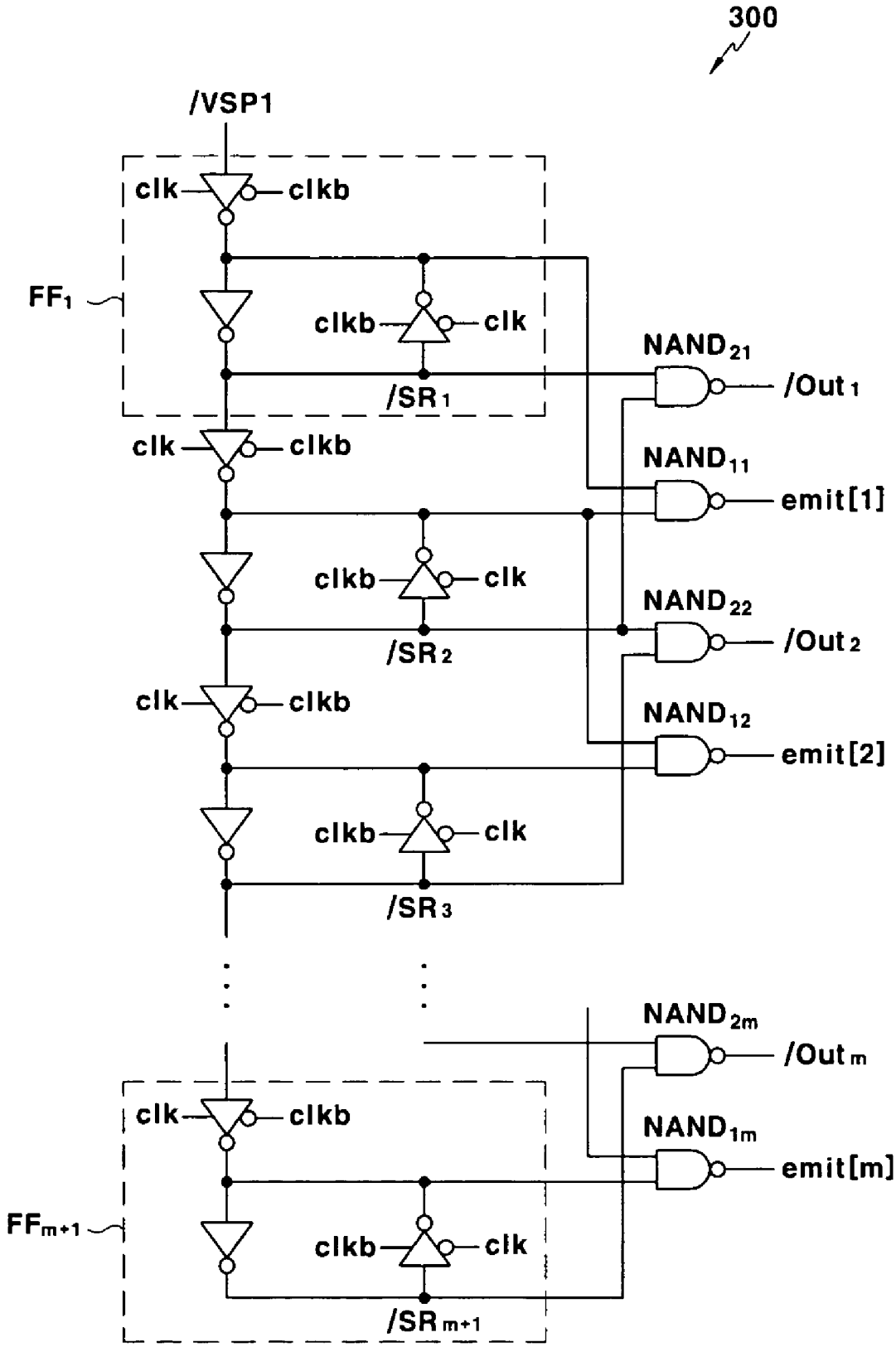
FIG. 14 shows a scan driver to generate a selection signal and an emission control signal of FIG. 9 according to an exemplary embodiment of the present invention.

FIG. 14 illustrates the scan driver 300 to generate a selection signal and an emission control signal (or waveform) of FIG. 9 according to another embodiment of the present invention.

As shown therein, the scan driver 300 according to the embodiment of FIG. 14 generates emission control signals emit[1] to emit[i] using internal signals of the flip-flops $FF_1$ to $FF_{m+1}$, and differing from the embodiment of FIG. 10.

Further, the flip-flop $FF_1$ receives an inverted signal /VSP1 of the start signal VSP1 when the clock signal clk is high, and the inverted signal /VSP1 is maintained until the next high-level clock signal. The flip-flops $FF_2$ to $FF_{m+1}$ sequentially output a plurality of output signals $/SR_2$ to $SR_{m+1}$ while shifting the output signal $/SR_1$ of the flip-flop $FF_1$ by a half clock signal.

The odd numbered flip-flops receive the clock signals VCLK and VCLKb as the internal clock signals clk and clkb, and the even numbered flip-flops receive the clock signal VCLKb and VCLK as the internal clock signals clk and clkb in the embodiment of FIG. 14.

Further, the first NAND gate $NAND_{1i}$ outputs an emission control signal emit[i] by performing the NAND operation on an internal signal of the ith flip-flop $FF_i$ and the internal signal of the (i+1)th flip-flop $FF_{(i+1)}$. In other words, the first NAND gate $NADN_{1i}$ performs the NAND operation on the input signals of the inverter 312 included in the ith flip-flop $FF_i$ and the (i+1)th flip-flop $FF_{(i+1)}$ so as to generate the emission control signal emit[i].

The second NAND gate $NADN_{2i}$ outputs an output signal $/Out_i$ by performing the NAND operation on the output signal $/SR_i$ of the ith flip-flop $FF_i$ and the output signal $/SR_{i+1}$ of the (i+1)th flip-flop $FF_{(i+1)}$.

The detail of a circuit for generating the selection signal select[i] by using the output signal $/Out_i$ of the second NAND gate $NAND_{2i}$ according to the embodiment of FIG. 14 is substantially the same as the circuit described in the embodiment of FIGS. 10, 12, and/or 13, and therefore is not provided in more detail. However, since the output signal $/Out_i$ of the second NAND gate $NAND_{2i}$ is an inverted output signal $Out_i$, the selection signal select[i] can be generated by coupling the inverter to the output terminal of the second NAND gate $NAND_{2i}$ and performing the NAND operation on the output signal of the inverter and the clip signal CLIP.

In a like manner, an emission control signal can be generated by using the internal signal of the flip-flops $FF_1$ to $FF_{m+1}$, and a driving waveform can be substantially the same as the driving waveform according to the embodiment of FIG. 10.

FIG. 6 to FIG. 14 is generally focused on the pixel circuit of FIG. 5, and the switching transistors M2 to M4 are described as the P-channel transistor, but a scan driver of the present invention can be applied with other types of transistors with possible changes to the signal level of the described embodiments as are known to those skilled in the art and the present invention is not thereby limited.

In addition, the scan driver 300 that generates the selection signals select[1] to select[m] and the emission control signals emit[1] to emit[m], and the scan driver 400 that generates the boost signals boost[1] to boost[m] are shown as two separate drivers, but these scan drivers 300 and 400 can be provided as one driver.

For example, an inverted signal of the output signals $Out_1$ to $Out_m$ of the NOR gates $NOR_1$ to $NOR_{1m}$ in the scan driver 300 can be used as the boost signal, or the output signals $/Out_i$ to $/Out_m$ of the second NAND gates $NAND_{21}$ to $NAND_{2m}$ can be used as the boost signals.

Also, a structure of the driving circuit can be simplified by replacing these scan drivers 300 and 400 with one driver, and the number of signal lines provided in the display panel 100 can be reduced by using the same clock signal and input signal in the respective scan drivers 300 and 400.

Further, the scan driver generating the selection signals select[1] to select[m] and the emission control signals emit[1] to emit[m] are described as being provided by the driver 300, but can also be separately provided.

In addition, time for data programming can be extended by shifting the boost signal and elongating the width of the pulse by two times.

While this invention has been described in connection with certain exemplary embodiments, it is to be understood by those skilled in the art that the invention is not limited to the disclosed embodiments, but, on the contrary, is intended to cover various modifications included within the spirit and scope of the appended claims and equivalents thereof.

What is claimed is:

1. A display device comprising:

a plurality of data lines for transmitting data signals;

a plurality of first scan lines for transmitting selection signals; and a plurality of pixel circuits respectively coupled to the data lines and the first scan lines, wherein at least one of the plurality of pixel circuits comprises:

an emission device for displaying an image corresponding to data currents supplied thereto;

a first switch for transmitting at least one of the data signals transmitted through the data lines in response to at least one of the selection signals of at least one of the first scan lines;

a transistor having a first transistor electrode and a control electrode;

a first storage device coupled between the first transistor electrode and the control electrode of the transistor, and for storing a first voltage corresponding to the at least one data signal from the first switch;

a second storage device between the control electrode of the transistor and a second scan line for transmitting a first control signal, and for switching the first voltage of the first storage device into a second voltage by coupling with the first storage device when the first control signal is changed into a second level from a first level; and a second switch for transmitting a current outputted from the transistor to the emission device in response to a second control signal, wherein the first control signal is maintained at the first level during a horizontal period.

2. The display device according to claim 1, wherein when the at least one selection signal is in an enable-level period, the enable-level period is included in the horizontal period.

3. The display device according to claim 1, wherein when the second control signal is in a disable-level period, the disable-level period is included in the horizontal period.

4. The display device according to claim 3, wherein the disable-level period of the second control signal corresponds to an integer times the horizontal period.

5. The display device according to claim 1, wherein the at least one of the pixel circuits further comprises a third switch for diode-connecting the transistor in response to the at least one selection signal and wherein the transistor is diode-connected while the at least one data signal is transmitted from the first switch.

6. The display device according to claim 1, further comprising a first scan driver for applying the selection signals to the first scan lines, and a second scan driver for generating the second control signal.

7. The display device according to claim 6, wherein the first scan driver and the second scan driver comprise a shift register for sequentially delaying an input signal having a pulse at a third level by a first period to generate a plurality of output signals.

8. The display device according to claim 7, wherein the shift register comprises a plurality of flip-flops for delaying the input signal by the first period to output the delayed input signal as the output signals.

9. The display device according to claim 8, wherein each of the flip-flops comprises a first inverter synchronized to a first clock signal and for inverting the input signal to output a result signal, a second inverter for inverting the result signal of the first inverter and for outputting an inverted signal as at least one of the output signals, and a third inverter coupled to both ends of the second inverter, synchronized to a second clock signal, and for inverting the at least one output signal to output the inverted signal.

10. The display device according to claim 9, wherein the first clock signal and the second clock signal are inverted with respect to each other.

11. The display device according to claim 10, wherein the first clock signal applied to odd numbered flip-flops of the plurality of flip-flops and the first clock signal applied to even numbered flip-flops of the plurality of flip-flops are inverted with respect to each other.

12. The display device according to claim 9, wherein the first period is substantially the same as a half period of the first clock signal.

13. A display device comprising:

a plurality of data lines for transmitting data signals;

a plurality of first scan lines for transmitting selection signals; and a plurality of pixel circuits respectively coupled to the data lines and the first scan lines, wherein at least one of the plurality of pixel circuits comprises:

an emission device for displaying an image corresponding to data currents supplied thereto;

a first switch for transmitting at least one of the data signals transmitted through the data lines in response to at least one of the selection signals of at least one of the first scan lines;

a transistor having a first transistor electrode and a control electrode;

a first storage device coupled between the first transistor electrode and the control electrode of the transistor, and for storing a first voltage corresponding to the at least one data signal from the first switch;

a second storage device coupled to the control electrode of the transistor and a second scan line for transmitting a first control signal, and for switching the first voltage of the first storage device into a second voltage by coupling with the first storage device when the first control signal is changed into a second level from a first level;

a second switch for transmitting a current outputted from the transistor to the emission device in response to a second control signal, wherein the first control signal is maintained at the first level during a horizontal period; and a first scan driver for applying the selection signals to the first scan lines, and a second scan driver for generating the second control signal, wherein the first scan driver and the second scan driver comprise a shift register for sequentially delaying an input signal having a pulse at a third level by a first period to generate a plurality of output signals, wherein the shift register comprises a plurality of flip-flops for delaying the input signal by the first period to output the delayed input signal as the output signals, wherein each of the flip-flops comprises a first inverter synchronized to a first clock signal and for inverting the input signal to output a result signal, a second inverter for inverting the result signal of the first inverter and for outputting an inverted signal as at least one of the output signals, and a third inverter coupled to both ends of the second inverter, synchronized to a second clock signal, and for inverting the at least one output signal to output the inverted signal, and wherein the second scan driver generates a signal having a pulse at a fourth-level when the result signal of the first inverter included in adjacent flip-flops is at the third level, and outputs the signal having the pulse at the fourth level as the at least one second control signal.

14. The display device according to claim 7, wherein the first scan driver and the second scan driver share the shift register.

15. A display device comprising:

a plurality of data lines for transmitting data signals;

a plurality of first scan lines for transmitting selection signals; and a plurality of pixel circuits respectively coupled to the data lines and the first scan lines, wherein at least one of the plurality of pixel circuits comprises:

an emission device for displaying an image corresponding to data currents supplied thereto;

a first switch for transmitting at least one of the data signals transmitted through the data lines in response to at least one of the selection signals of at least one of the first scan lines;

a transistor having a first transistor electrode and a control electrode;

a first storage device coupled between the first transistor electrode and the control electrode of the transistor, and for storing a first voltage corresponding to the at least one data signal from the first switch;

a second storage device coupled to the control electrode of the transistor and a second scan line for transmitting a first control signal, and for switching the first voltage of the first storage device into a second voltage by coupling with the first storage device when the first control signal is changed into a second level from a first level;

a second switch for transmitting a current outputted from the transistor to the emission device in response to a second control signal, wherein the first control signal is maintained at the first level during a horizontal period; and a first scan driver for applying the selection signals to the first scan lines, and a second scan driver for generating the second control signal, wherein the first scan driver and the second scan driver comprise a shift register for sequentially delaying an input signal having a pulse at a third level by a first period to generate a plurality of output signals, and wherein the first scan driver comprises a first logical operator for receiving two adjacent output signals outputted from the shift register and for outputting a first signal having a pulse at a fourth level when the two output signals are at the third level; and a second logical operator for receiving the first signal outputted from the first logical operator and a second signal having a pulse at the third level for a certain period within the horizontal period, and for outputting a signal having a pulse at the third-level as at least one of the selection signals when the first signal and the second signal are both at the fourth level.

16. A display device comprising:

a plurality of data lines for transmitting data signals;

a plurality of first scan lines for transmitting selection signals; and a plurality of pixel circuits respectively coupled to the data lines and the first scan lines, wherein at least one of the plurality of pixel circuits comprises:

an emission device for displaying an image corresponding to data currents supplied thereto;

a first switch for transmitting at least one of the data signals transmitted through the data lines in response to at least one of the selection signals of at least one of the first scan lines;

a transistor having a first transistor electrode and a control electrode;

a first storage device coupled between the first transistor electrode and the control electrode of the transistor, and for storing a first voltage corresponding to the at least one data signal from the first switch;

a second storage device coupled to the control electrode of the transistor and a second scan line for transmitting a first control signal, and for switching the first voltage of the first storage device into a second voltage by coupling with the first storage device when the first control signal is changed into a second level from a first level;

a second switch for transmitting a current outputted from the transistor to the emission device in response to a second control signal, wherein the first control signal is maintained at the first level during a horizontal period; and a first scan driver for applying the selection signals to the first scan lines, and a second scan driver for generating the second control signal, wherein the first scan driver and the second scan driver comprise a shift register for sequentially delaying an input signal having a pulse at a third level by a first period to generate a plurality of output signals, wherein the second scan driver receives two adjacent output signals outputted from the shift register, and outputs a signal having a pulse at a fourth level as the second control signal when one of the two output signals is in the third level.

17. A display device comprising:

a display panel comprising a plurality of data lines for transmitting data signals, a plurality of first scan lines for transmitting selection signals, a plurality of second scan lines for transmitting emission control signals, and a plurality of pixel circuits respectively coupled to the data lines, the first scan lines, and the second scan lines;

a data driver for applying the data signals to the data lines;

a first scan driver for applying the selection signals to the first scan lines; and a second scan driver for applying the emission control signals to the second scan lines, wherein the first scan driver and the second scan driver comprise a shift register for sequentially delaying a first signal having a pulse at a first level by a first period to generate a plurality of second signals, wherein the first scan driver comprises a first logical operator for receiving two adjacent second signals outputted from the shift register and outputting a third signal having a pulse at a fourth level when the two second signals are both at a third level; and a second logical operator for receiving the third signal outputted from the first logical operator and a fourth signal having a pulse at the third level for a part of a horizontal period, and for outputting a signal having a pulse at the third-level as at least one of the selection signals when the third signal and the fourth signal both are at the fourth level, and wherein the second scan driver receives the two adjacent second signals outputted from the shift register, and outputs a signal having a pulse at the fourth-level as at least one of the emission control signals when one of the two adjacent second signals is at the third level.

18. The display device according to claim 17, wherein at least one of the pixel circuits comprises:

an emission device for emitting an image corresponding to a current applied thereto;

a first switch for transmitting at least one of the data signals in response to at least one of the selection signals;

a transistor being diode-connected while the at least one data signal is transmitted from the first switch;

a first storage device coupled between a first transistor electrode and a control electrode of the transistor;

a second storage device coupled to the control electrode and a third scan line for transmitting a first control signal; and a second switch for transmitting a current outputted from the transistor to the emission device in response to at least one of the emission control signals.

19. The display device according to claim 18, wherein the first control signal is an inverted signal of the third signal.

20. The display device according to claim 18, further comprising a third scan driver applying the first control signal to the third scan line.

21. The display device according to claim 18, wherein the at least one pixel circuit further comprises a third switch for diode-connecting the transistor in response to the at least one selection signal.

22. A display panel comprising a display panel having a plurality of data lines for transmitting data signals, a plurality of scan lines for transmitting selection signals, and a plurality of pixel circuits formed on a plurality of pixels respectively defined by the data lines and the scan lines, wherein at least one of the pixel circuits comprises:

an emission device for displaying an image corresponding to data currents supplied thereto;

a first switch for transmitting at least one of the data signals transmitted through at least one of the data lines in response to at least one of the selection signals of at least one of the scan lines;

a transistor for supplying a driving current to drive the emission device, and having a first transistor electrode and a control electrode;

a first storage device coupled between the first transistor electrode and the control electrode of the transistor;

a second storage device coupled between the control electrode of the transistor and a signal line for supplying a first control signal; and a second switch coupling a second transistor electrode of the transistor and the emission device in response to a second control signal, wherein when the at least one selection signal is in an enable period, the enable period is set to be included in a horizontal period, and wherein the second control signal includes a disable period that is set to be an integer times the horizontal period.

23. The display panel according to claim 22, wherein the first control signal is maintained at a first level during the horizontal period, and is otherwise maintained at a second level.

24. The display panel according to claim 22, wherein the pixel circuit further comprises a third switch for diode-connecting the transistor in response to the at least one selection signal and wherein the transistor is diode-connected while the at least one data signal is transmitted from the first switch.

25. The display panel according to claim 22, further comprising a first scan driver for supplying the selection signals to the scan lines, and a second scan driver for generating the second control signal.

26. The display panel according to claim 25, wherein the first scan driver and the second scan driver comprise a shift register for sequentially delaying a first signal having a pulse at a third level by a first period to generate a plurality of second signals.

27. The display panel according to 26, wherein the first scan driver comprises a first logical operator for receiving two adjacent second signals outputted from the shift register and for outputting a third signal having a pulse at a fourth level when the two second signals are at the third level; and a second logical operator for receiving the third signal outputted from the first logical operator and a fourth signal having a pulse at the third level for a part within the horizontal period, and for outputting a signal having a pulse at the third level as at least one of the selection signals when the third signal and the fourth signal both are at the fourth level.

28. The display panel according to claim 26, wherein the second scan driver receives two adjacent second signals outputted from the shift register, and outputs a signal having a pulse at a fourth level as the second control signal when one of the two second signals is at the third level.

29. A method for driving a display device comprising a plurality of data lines for transmitting data signals, a plurality of first scan lines for transmitting selection signals, a plurality of second scan lines for transmitting first control signals, and a plurality of pixel circuits respectively coupled to the data lines and the first scan lines, at least one of the plurality of pixel circuits comprising a first switch for transmitting a data current from at least one of the data lines in response to a pulse at a first level of at least one of the selection signals, a transistor having a first transistor electrode and a control electrode, a first storage device formed between the first transistor electrode and the control electrode, a second storage device formed between the control electrode and at least one of the second scan lines, and an emission device for displaying an image corresponding to a current from the transistor, the method comprising:

changing at least one of the first control signals to a fourth level from a third level and maintaining the at least one first control signal in the fourth level during a horizontal period;

changing the at least one selection signal from a second level to the first level and charging a voltage corresponding to the data current to the first storage device during a first period; and changing the at least one first control signal from the fourth level to the third level to change the voltage in the first storage device.

30. The method according to claim 29, wherein the at least one pixel circuit further comprises a second switch for diode-connecting the transistor in response to the at least one selection signal.

31. The method according to claim 29, wherein the first period is set to be included within the horizontal period.

32. The method according to claim 29, further comprising a third switch for cutting off a current flowing to the emission device from the transistor in response to a pulse at a fifth level of a second control signal.

33. The method according to claim 32, further comprising changing the second control signal from a sixth level into the fifth level prior to the changing the first control signal to the fourth level from the third level, and maintaining the second control signal at the fifth level during a second period.

34. The method according to claim 33, wherein the second period is set to include the horizontal period.

35. The method according to claim 34, wherein the second period is set to be an integer times the horizontal period.

* * * * *